US011512541B2

(12) United States Patent
Al-Johar et al.

(10) Patent No.: US 11,512,541 B2
(45) Date of Patent: Nov. 29, 2022

(54) HYDRAULICALLY DRIVEN HOLE CLEANING APPARATUS

(71) Applicant: SAUDI ARABIAN OIL COMPANY, Dhahran (SA)

(72) Inventors: Abdulwahab S. Al-Johar, Dhahran (SA); Mohammed Murif Al-Rubaii, Dammam (SA); Abdullah S. Al-Yami, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 60 days.

(21) Appl. No.: 17/106,655

(22) Filed: Nov. 30, 2020

(65) Prior Publication Data

US 2022/0170331 A1 Jun. 2, 2022

(51) Int. Cl.
*E21B 21/00* (2006.01)
*E21B 4/16* (2006.01)

(52) U.S. Cl.
CPC ..... *E21B 21/00* (2013.01); *E21B 4/16* (2013.01)

(58) Field of Classification Search
CPC ..... E21B 21/001–18
See application file for complete search history.

(56) References Cited

U.S. PATENT DOCUMENTS

| | | | |
|---|---|---|---|
| 5,695,015 A | 12/1997 | Barr et al. | |
| 6,223,840 B1 | 5/2001 | Swietlik | |
| 2004/0188145 A1* | 9/2004 | Moyes | E21B 4/02 175/65 |

FOREIGN PATENT DOCUMENTS

| | | |
|---|---|---|
| CN | 205063870 U | 3/2016 |
| CN | 110159185 A | 8/2019 |
| CN | 209761367 U | 12/2019 |
| WO | 2005093204 A1 | 10/2005 |

OTHER PUBLICATIONS

International Search Report and Written Opinion issued in Application No. PCT/US2021/061163, dated Mar. 4, 2022 (12 pages).

* cited by examiner

*Primary Examiner* — Kristyn A Hall

(74) *Attorney, Agent, or Firm* — Osha Bergman Watanabe & Burton LLP

(57) ABSTRACT

An apparatus includes a tool body having a bore that is aligned with a lengthwise axis and a rotating assembly coupled to the tool body. The rotating assembly includes a turbine wheel that is disposed adjacent to an inner surface of the wall and exposed to the bore. The rotating assembly includes an impeller that is disposed adjacent to an outer surface of the wall in a position corresponding to the turbine wheel. Each of the turbine wheel and impeller has a respective axis of rotation that is transverse to the lengthwise axis. The rotating assembly includes a link rod that couples the turbine wheel to the impeller and is used to transfer mechanical energy generated by the turbine wheel to the impeller. The apparatus is operable by fluid flow through a drill string to increase pressure in a wellbore annulus and enhance transportation of formation cuttings up the annulus.

20 Claims, 11 Drawing Sheets

HYDRAULICALLY DRIVEN HOLE CLEANING APPARATUS

BACKGROUND

While drilling a wellbore with a drill string, drilling fluid is typically circulated through the wellbore by pumping the drilling fluid into the drill string. At the end of the drill string is a drill bit with nozzles. The drilling fluid pumped into the drill string exits into the bottom of the wellbore through the nozzles in the drill bit and moves up an annulus between the drill string and the wellbore to the surface, where the drilling fluid is received, cleaned, and circulated back into the wellbore. Drilling fluid serves various purposes, including cleaning the bottom of the wellbore; cooling, cleaning, and lubricating the drill bit; maintaining the wall of the wellbore; transporting formation cuttings from the drill bit to the surface; and preventing formation fluid influx to the well.

The process of transporting formation cuttings from the drill bit to the surface is known as hole cleaning. Failure to perform efficient hole cleaning may lead to development of cuttings bed in the annulus. Cuttings bed in an annulus leads to complications in drilling, such as decreased annulus area for return flow to the surface, increased torque and drag on the drill string that can prevent continued drilling to a target depth, formation fracturing due to the increased effective density acting on the formation, and mechanical sticking of the drill pipe.

Hole cleaning is affected by various factors, such as flow rate of the drilling fluid, rheological properties of the drill fluid, inclination angle of the hole, rotation of the drill string, eccentricity of the drill pipe in the hole, rate of penetration of the drilling, and characteristics of the formation cuttings, e.g., density, size, and shape of the cuttings. A critical flow rate exists below which cuttings slump down and form a stationary cuttings bed in the annulus. It is generally desirable to maintain the flow rate through the annulus above the critical flow rate to avoid development of stationary cuttings bed. A higher flow rate is typically achieved by increasing the fluid pump rate. However, flow rate is constrained by the allowed equivalent circulating density, which is constrained at a lower end by formation pore pressure gradient and at an upper end by fracture gradient and by the standpipe pressure. In some drilling scenarios, it may not be possible to increase the flow rate to a level high enough to avoid development of stationary cuttings bed.

In current drilling operations, drilling rig crews depend on following a set of "best practices" to ensure proper hole cleaning. These best practices include applying a minimum pipe rotation and a minimum flow rate for each hole size, keeping drilling fluid rheology within a certain range based on hole size, pumping hole cleaning sweeps, and performing short round trips every 1000 ft of drilled new formation to evaluate the hole condition. A hole cleaning sweep is a drilling fluid with two different characteristics. When the sweep reaches the annulus, the sweep will create a turbulent flow, which will help in moving cuttings out of the hole.

SUMMARY

In a first summary example, a hole cleaning apparatus includes a tool body having a lengthwise axis and a wall defining a bore that is aligned with the lengthwise axis. The hole cleaning apparatus includes one or more rotating assemblies coupled to the tool body. Each of the rotating assemblies includes a turbine wheel, an impeller, and a link rod. The turbine wheel is disposed adjacent to an inner surface of the wall and exposed to the bore. The impeller is disposed adjacent to an outer surface of the wall in a position corresponding to the turbine wheel. Each of the turbine wheel and impeller has a respective axis of rotation that is transverse to the lengthwise axis. The link rod operatively couples the turbine wheel to the impeller and is used to transfer mechanical energy generated by the turbine wheel to the impeller.

In the first summary example, the link rod may pass through a portion of the wall of the tool body between the turbine wheel and the impeller. The link rod may be rotatably supported by a bearing mounted in the portion of the wall of the tool body.

In the first summary example, the turbine wheel may have a higher hydrodynamic drag in comparison to the impeller when the turbine wheel and the impeller are immersed in a fluid. The impeller may be a radial impeller.

In the first summary example, the hole cleaning apparatus may include an impeller casing mounted around the impeller to provide a chamber around the impeller that guides flow from the impeller. The impeller casing may have an opening forming an outlet port that is fluidly connected to the chamber. The chamber may be a volute chamber. An external shield may be disposed around the tool body with a space between the external shield and the tool body to accommodate the impeller casing and the impeller. The external shield may include an opening forming an inlet port that is fluidly connected to the chamber.

In the first summary example, the hole cleaning apparatus may include a plurality of the rotating assemblies coupled to the tool body. The rotating assemblies may be uniformly distributed along a circumference of the tool body.

In a second summary example, a drill string includes a drill bit and one or more drill pipes coupled together to form a conduit that is fluidly connected to the drill bit. The drill string includes one or more hole cleaning apparatuses disposed along the conduit. Each hole cleaning apparatus includes a tool body having a lengthwise axis and a wall defining a bore that is aligned with the lengthwise axis and fluidly connected to the conduit. Each hole cleaning apparatus includes one or more rotating assemblies coupled to the tool body. Each rotating assembly includes a turbine wheel, an impeller, and a link rod. The turbine wheel is disposed adjacent to an inner surface of the wall and exposed to the bore. The impeller is disposed adjacent to an outer surface of the wall in a position corresponding to the turbine wheel. Each of the turbine wheel and impeller has a respective axis of rotation that is transverse to the lengthwise axis. The link rod operatively couples the turbine wheel to the impeller and is used to transfer mechanical energy generated by the turbine wheel to the impeller.

In the second summary example, for each corresponding turbine wheel and impeller, the turbine wheel may have a higher hydrodynamic drag in comparison to the impeller when the turbine wheel and the impeller are immersed in a fluid. The impeller may be an open impeller or a semi-open impeller. The impeller may be a radial impeller.

In the second summary example, an impeller casing may be mounted around each impeller. The impeller casing provides a chamber around the impeller that guides flow from the impeller. Each impeller casing may have an opening forming an outlet port that is fluidly connected to the respective chamber. The chamber may be a volute chamber. An external shield may be disposed around the tool body of each hole cleaning apparatus with a space between the external shield and the tool body to accommodate the impeller casing(s) and impeller(s) associated with the hole cleaning apparatus. The external shield may include an opening forming an inlet port that is fluidly connected to the chamber. Each impeller casing may be connected to the external shield.

In the second summary example, a plurality of rotating assemblies may be coupled to the tool body of each hole cleaning apparatus. The rotating assemblies may be uniformly distributed along a circumference of the respective tool body.

In a third summary example, a method includes disposing a drill string including at least one hole cleaning apparatus in a wellbore, pumping fluid into the drill string while operating the drill string to cut into a subsurface formation around the wellbore, and returning the fluid pumped into the drill string and cuttings from the subsurface formation to a surface through an annulus between the drill string and the wellbore. During pumping of the fluid into the drill string, the method includes rotating at least one turbine wheel disposed inside a tool body of the hole cleaning apparatus by the fluid passing through the drill string. The method additionally includes rotating at least one impeller disposed outside the tool body of the hole cleaning apparatus in response to rotation of the at least one turbine wheel. A pressure of the fluid in the annulus at a location of the at least one impeller is increased by rotation of the at least one impeller.

In the third summary example, the at least one turbine wheel may be rotated about an axis of rotation that is transverse to a lengthwise axis of the tool body of the hole cleaning apparatus, and the at least one impeller may be rotated about an axis of rotation that is transverse to a lengthwise axis of the tool body of the hole cleaning apparatus.

The foregoing general description and the following detailed description are exemplary of the invention and are intended to provide an overview or framework for understanding the nature of the invention as it is claimed. The accompanying drawings are included to provide further understanding of the invention and are incorporated in and constitute a part of the specification. The drawings illustrate various embodiments of the invention and together with the description serve to explain the principles and operation of the invention.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
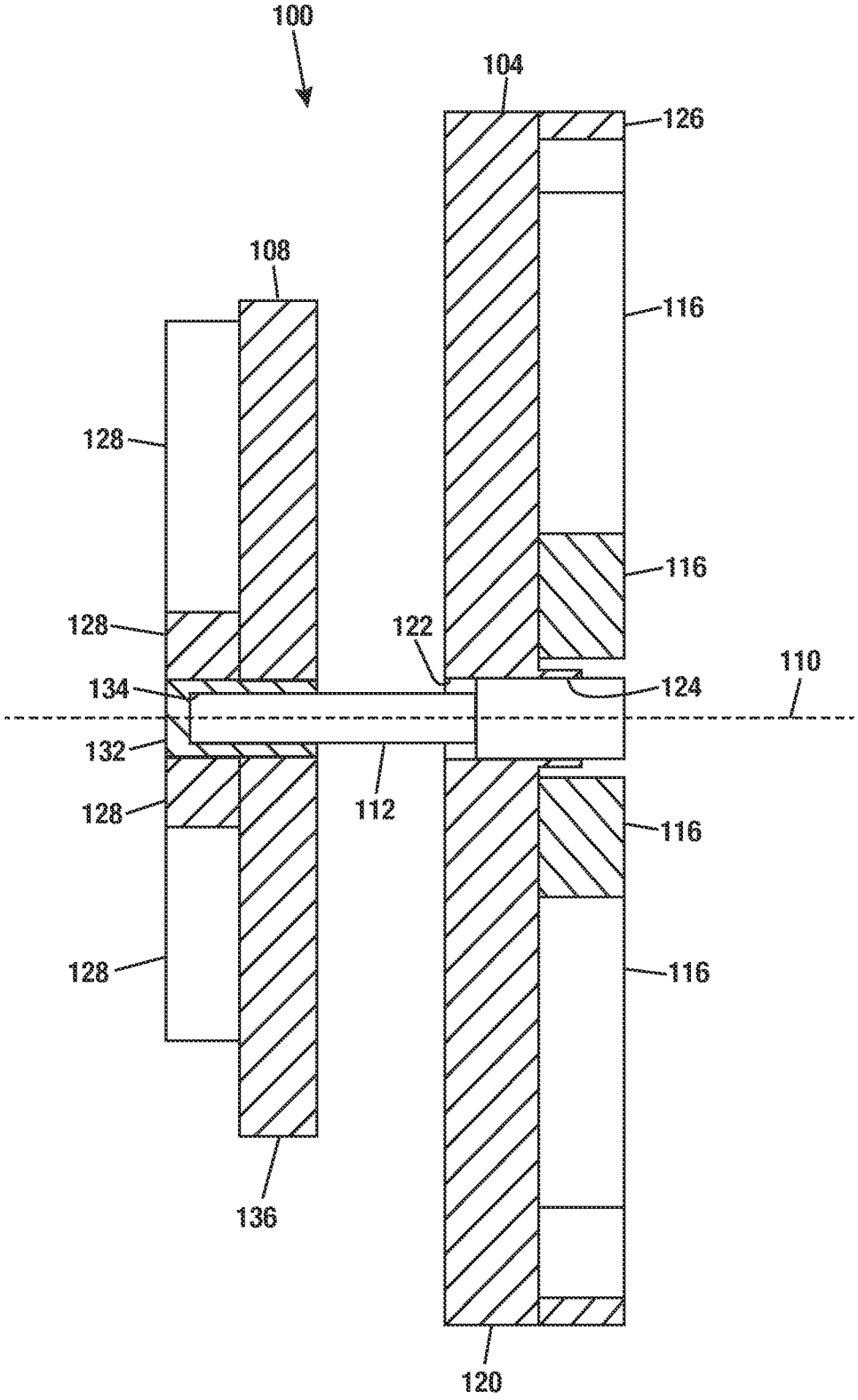
FIG. 1 is a cross-sectional view of a rotating assembly for use in a hole cleaning apparatus.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. In other instances, related well known features or processes have not been shown or described in detail to avoid unnecessarily obscuring the implementations and embodiments. For the sake of continuity, and in the interest of conciseness, same or similar reference characters may be used for same or similar objects in multiple figures.

A hole cleaning apparatus that may be installed in a drill string is described herein. The hole cleaning apparatus includes one or more rotating assemblies that operate to increase the pressure in the annulus of a wellbore while the drill string is used in the wellbore. The extra pressure will assist in transporting formation cuttings up the annulus. Advantageously, the hole cleaning apparatus will reduce the need for hole sweeps to ensure proper hole cleaning.

FIG. 1 shows one illustrative implementation of a rotating assembly 100 that may be included in a hole cleaning apparatus for the purpose of enhancing hole cleaning while drilling. Rotating assembly 100 includes a turbine wheel 104 and an impeller 108, which are positioned in spaced apart relation along a main axis 110. The axes of rotation of turbine wheel 104 and impeller 108 are parallel to main axis 110. In the illustrated example, the axes of rotation of turbine wheel 104 and impeller 108 are coincident with each other and main axis 110. However, it is possible that the axes of rotation of turbine wheel 104 and impeller 108 could be offset from each other while remaining parallel to main axis 110. In use, turbine wheel 104 extracts hydraulic energy from a first fluid stream and converts the hydraulic energy to mechanical energy, and impeller 108 converts the mechanical energy from turbine wheel 104 to pressure energy in a second fluid stream. Turbine wheel 104 and impeller 108 are coupled together by a link rod (or linkage) 112 such that the mechanical energy generated by turbine wheel 104 can be transferred to impeller 104 through link rod 112.

Figure 2:
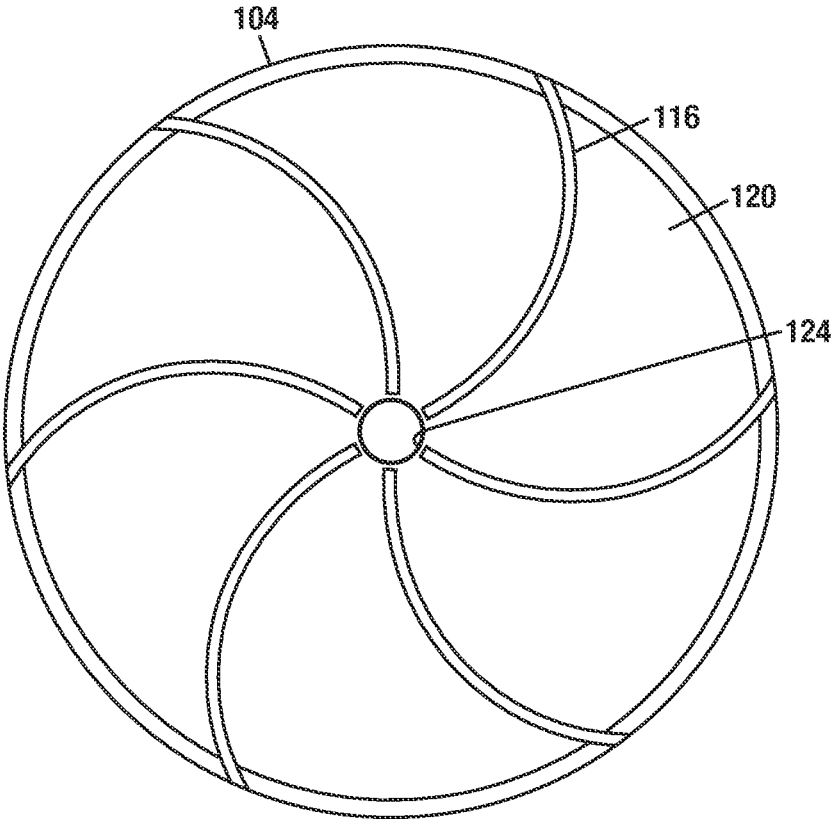
FIG. 2 is a front elevation view of a turbine wheel of the rotating assembly of FIG. 1.

In one example, as illustrated in FIGS. 1 and 2, turbine wheel 104 includes a disc wheel 120 having a central opening 124 to receive an end portion of link rod 112. Central opening 124 may include any suitable features to attach the end portion of link rod 112 to disc wheel 120, such as, but not limited to, threads. Blades 116 are attached to disc wheel 120 and arranged around central opening 124. Although six blades are shown in FIG. 2, the number of blades may be variable, for example, in a range from 6 to 12. Blades 116 are shown as spiral curved blades in FIG. 2. However, blades 116 could have other types of curved shapes. In alternative examples, blades 116 could be straight or flat blades. In some cases, an open wheel, i.e., a wheel in the form of a ring, may be used instead of disc wheel 120. Other turbine wheel designs known in the art may be used.

Figure 3:
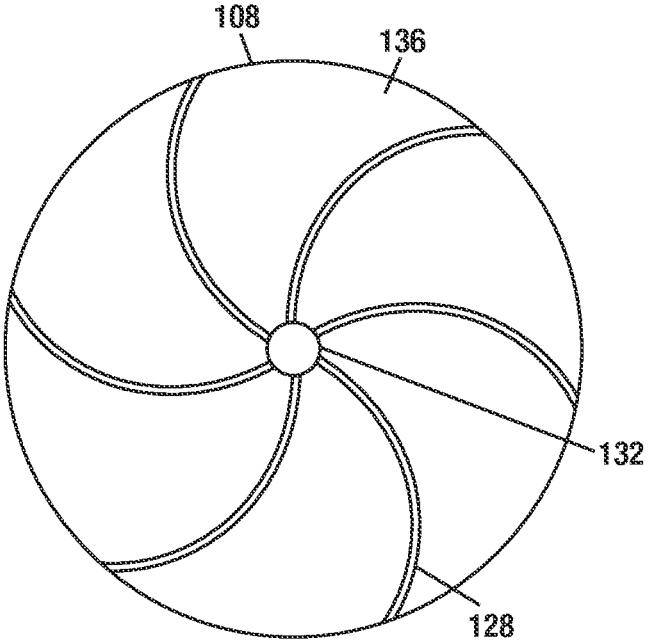
FIG. 3 is a front elevation view of an impeller of the rotating assembly of FIG. 1.

Returning to FIG. 1, impeller 108 may be a radial impeller. A radial impeller is an impeller that causes fluid to move in a radial direction relative to an axis of rotation of the impeller. In one example, as illustrated in FIGS. 1 and 3, impeller 108 includes blades 128 disposed around a central hub 132 and a shroud 136 disposed on one side of blades 128. The presence of shroud 136 on one side of blades 128 implies a semi-open impeller design. Shroud 136 may be omitted for an open impeller design. Blades 128 are shown as spiral curved blades. However, blades 128 could have other types of curved shapes as well as straight shapes. Blades 128 may be attached to central hub 132 in some cases. For the semi-open impeller design, shroud 136 may be attached to or integrally formed with central hub 132, and blades 128 may be attached to either or both of central hub 132 and shroud 136. Central hub 132 has an opening 134 (in FIG. 1) to receive an end portion of link rod 112. Opening 134 may include any suitable features to attach the end portion of link rod 112 to central hub 132, such as, but not limited to, threads. Other impeller designs known in the art, particularly the art of pumps, may be used.

Returning to FIG. 1, turbine wheel 104 and impeller 108 are preferably designed such that when turbine wheel 104 and impeller 108 are immersed in fluid, the hydrodynamic drag exerted on turbine wheel 104 will be greater than the hydrodynamic drag exerted on impeller 108. The relative hydrodynamic drag exerted on turbine wheel 104 and impeller 108 may be achieved by controlling the relative size and/or shape of the turbine wheel and impeller. For example, turbine wheel 104 may have a larger diameter compared to impeller 108. Designing the hydrodynamic drag exerted on turbine wheel 104 to be greater than the hydrodynamic drag exerted on impeller 108 will ensure that turbine wheel 104 consumes energy from the fluid and transfers the energy to impeller 108 through link rod 112. In use, turbine wheel 104 may be positioned to be exposed to fluid flow in a drill string, and impeller 108 may be positioned to be exposed to fluid flow in an annulus of a wellbore. Rotation of turbine wheel 104 by fluid flow through the drill string will generate mechanical energy that is transferred to impeller 108 through link rod 112. In turn, the rotation of impeller 108 will create an additional pressure gradient in the annulus that can enhance hole cleaning.

Figure 4:
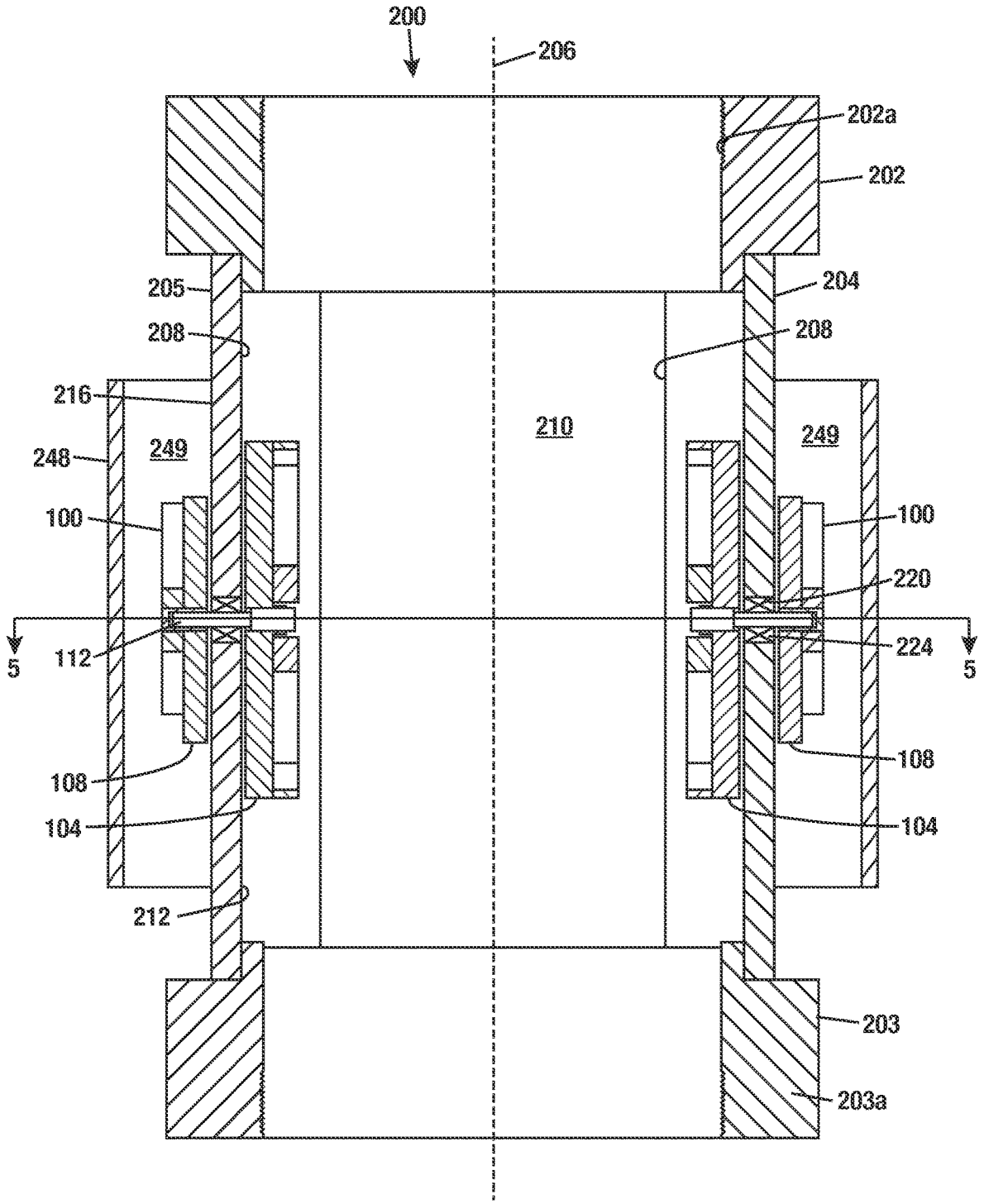
FIG. 4 is a cross-sectional view of a hole cleaning apparatus.
Figure 5:
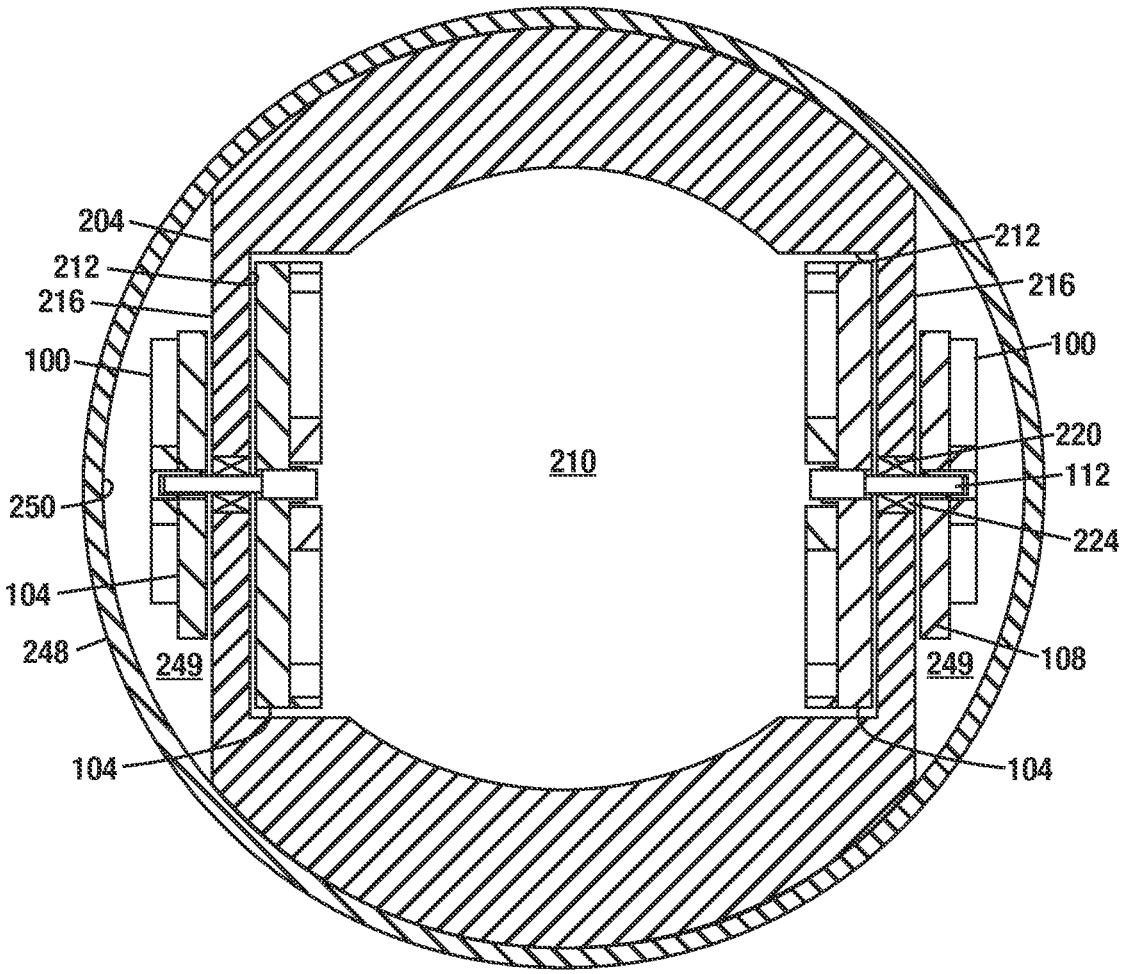
FIG. 5 is a cross-sectional view of the hole cleaning apparatus of FIG. 4 along line 5-5.

FIGS. 4 and 5 show a hole cleaning apparatus 200 including two rotating assemblies 100. Although two rotating assemblies are shown, hole cleaning apparatus 200 may generally include one or more rotating assemblies. In one implementation, hole cleaning apparatus 200 includes a tool body 204 to which rotating assemblies 100 are mounted. When hole cleaning apparatus 200 includes multiple rotating assemblies 100, the rotating assemblies may be uniformly distributed along a circumference of tool body 204. Tool body 204 has a lengthwise axis 206 (in FIG. 4). End connections 202, 203 may be provided at ends of tool body 204. End connections 202, 203 may have inner threaded surfaces 202*a*, 203*a* for engaging other components, such as drill string components. In some cases, threads may be provided on outer surfaces of either or both connections 202, 203. Tool body 204 includes a wall 205 having an inner wall surface 208 defining a bore 210, which extends along lengthwise axis 206. Flat wall recesses 212 are formed in inner wall surface 208 to accommodate turbine wheels 104 of rotating assemblies 100. In general, the number of recesses 212 will correspond to the number of turbine wheels 104 to be disposed inside tool body 204. In one example, when multiple recesses 212 are provided in inner wall surface 208 to accommodate multiple turbine wheels, the recesses may be uniformly distributed along inner wall surface 208. Recesses 212 are open to bore 210. Consequently, when turbine wheels 104 are mounted within recesses 212, turbine wheels 104 are exposed to bore 210.

Impellers 108 are disposed adjacent to an outer wall surface 216 of wall 205 and in positions corresponding to turbine wheels 104 in recesses 212. In the portion of wall 205 disposed between each corresponding turbine wheel 104 and impeller 108, a hole 220 is formed. Link rod 112 passes through hole 220 and operatively connects corresponding turbine wheel 104 and impeller 108. A bearing 224 may be mounted in hole 220 to support rotation of link rod 112. When each rotating assembly 100 is assembled to tool body 204 as shown in FIGS. 4 and 5, an axis of rotation of each of turbine wheel 104 and impeller 108 is transverse to lengthwise axis 206.

In one implementation, an external shield 248 is disposed around tool body 204 and impellers 108. External shield 248 may be a tubular wall and may be attached to tool body 204, as shown in FIG. 5, using any suitable method. Impellers 108 are located in channels 249 formed between an inner wall surface 250 of external shield 248 and outer wall surface 216 of tool body 204. Fluid can enter into and leave channels 249 through the open bottom and top ends of external shield 248.

Figure 6:
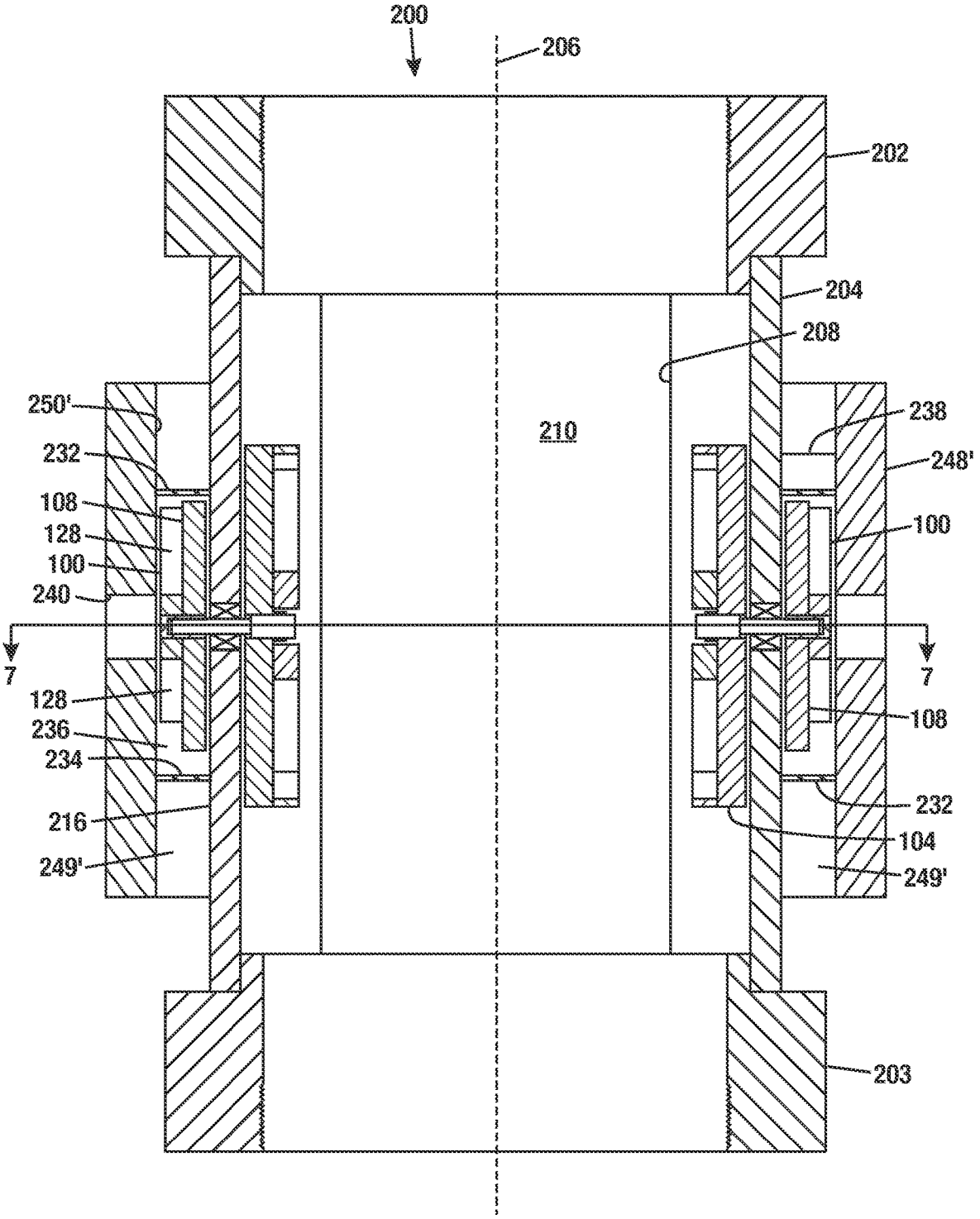
FIG. 6 is a cross-sectional view of a hole cleaning apparatus with impeller casings.
Figure 7:
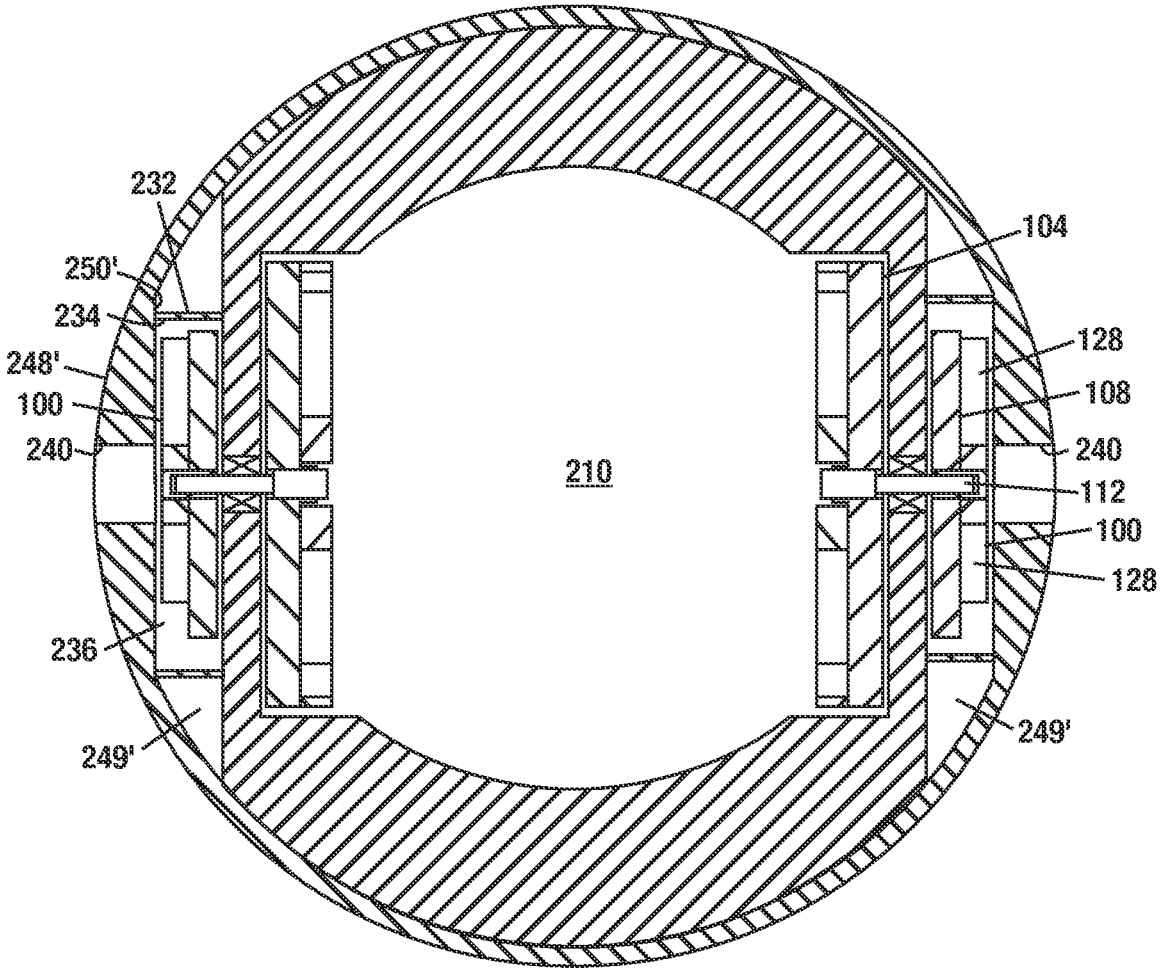
FIG. 7 is a cross-sectional view of FIG. 6 along line 7-7.
Figure 8:
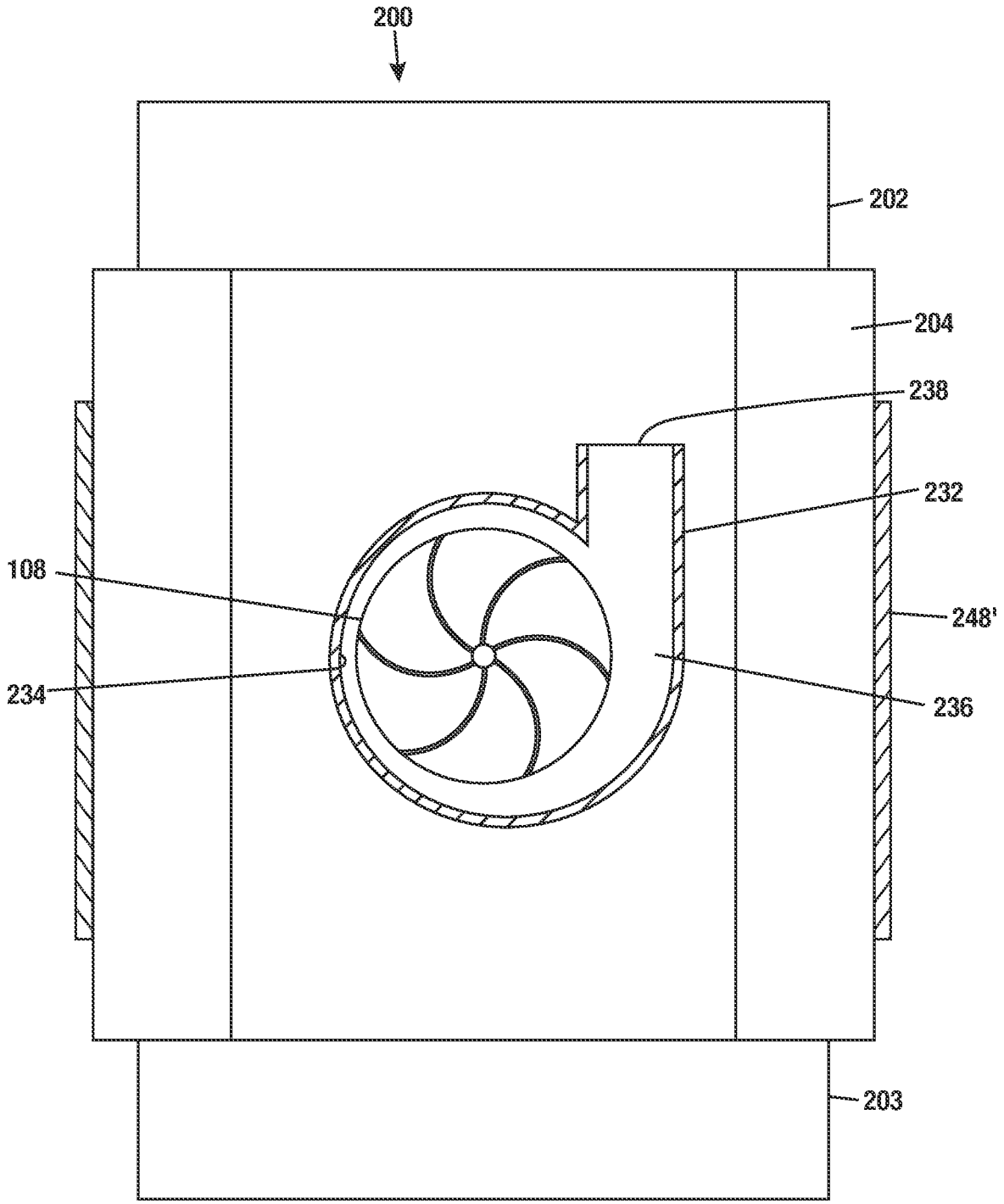
FIG. 8 is a partial cross-sectional view of the hole cleaning apparatus shown in FIGS. 6 and 7.
Figure 9:
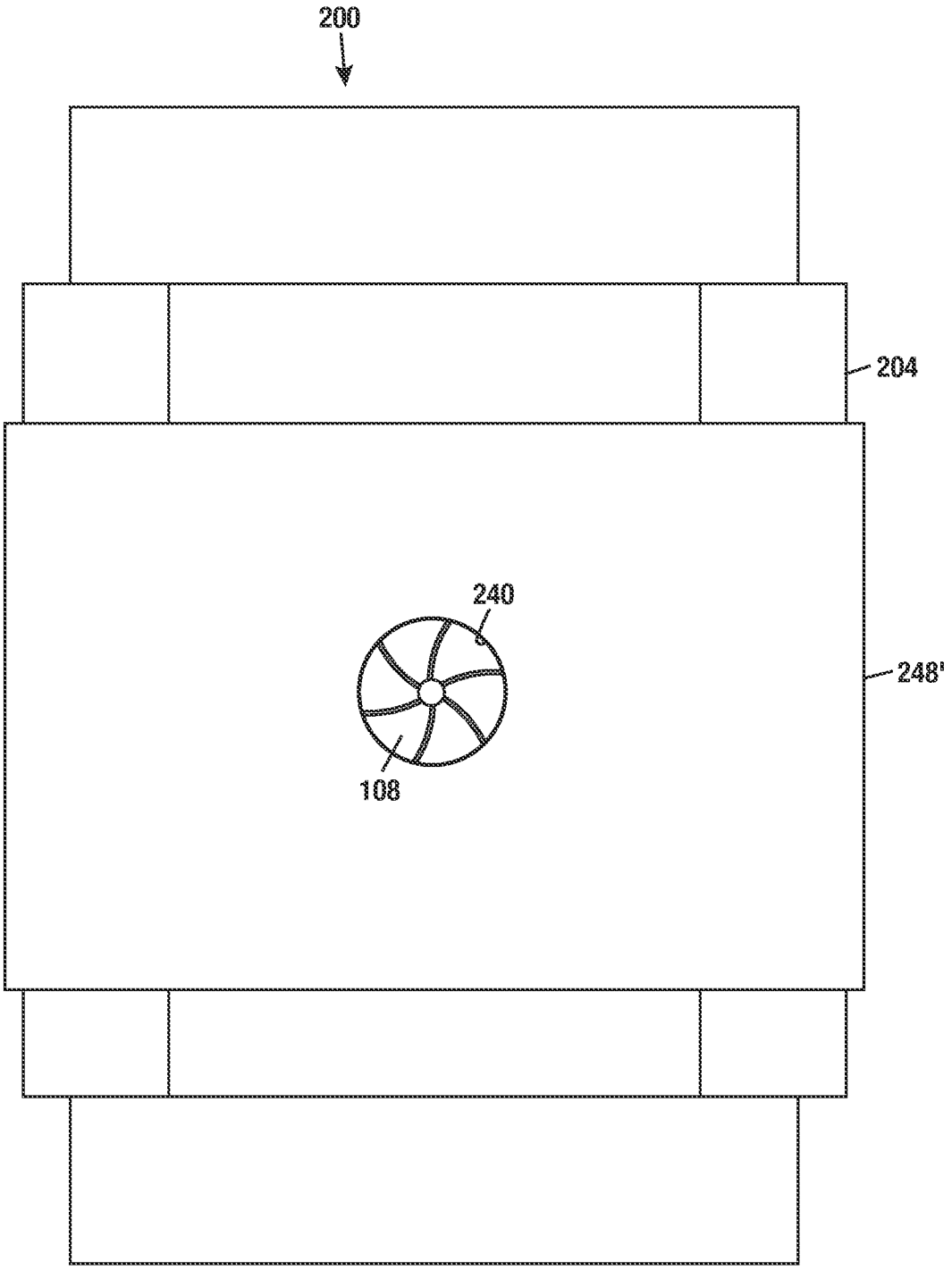
FIG. 9 is a side elevation view of the hole cleaning apparatus shown in FIGS. 6-8.

Impeller casings that guide impeller flow up hole cleaning apparatus 200 may be provided. As shown in FIGS. 6 and 7, an alternative external shield 248' carrying impeller casings 232 may be disposed around tool body 204 and impellers 108. Each impeller casing 232 includes an inner surface 234 that defines a chamber 236. A respective impeller 108 is received in chamber 236. As illustrated in FIG. 8, chamber 236 may be a volute chamber, i.e., a chamber having a curved funnel shape. An opening at a top end of impeller casing 232 provides an outlet port 238 that is fluidly connected with chamber 236. Returning to FIGS. 6 and 7, impeller casing 232 is disposed in a channel 249' formed between an inner wall surface 250' of external shield 248' and outer wall surface 216 of tool body 204. Impeller casing 232 may be attached to inner wall surface 250'. A portion of external shield 248' covering one side of chamber 236 includes an opening forming an inlet port 240 (see FIG. 9) that is fluidly connected to chamber 236. The positioning of external shield 248' may be such that inlet port 240 is aligned with the eye of impeller 108. The eye of an impeller is the point at which fluid enters the impeller and from which fluid spreads between the impeller blades. The eye is located at the center of the impeller and on the axis of rotation of the impeller.

Returning to FIGS. 6 and 7, fluid flowing outside hole cleaning apparatus 200 can enter the eye of impeller 108 through inlet port 240. The fluid will flow into spaces between blades 128 of impeller 108 to the circumference of impeller 108. As impeller 108 is driven by the respective turbine wheel 104, the rotational motion of impeller 108 will accelerate the flow passing between impeller blades 128 to inner surface 234 of impeller casing 232, which will then act to guide the flow to outlet port 238.

Figure 10:
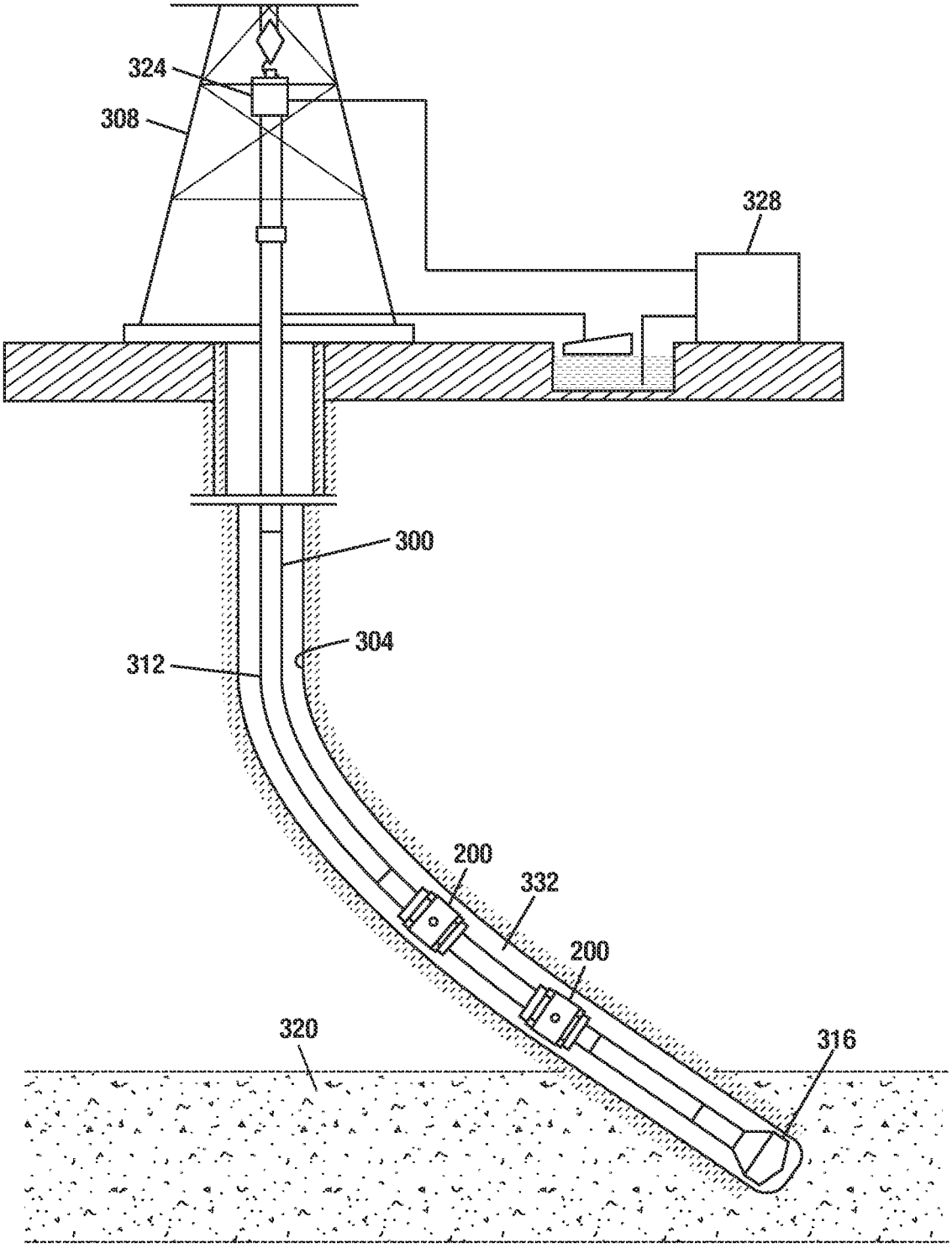
FIG. 10 is a schematic diagram of a drilling system incorporating one or more hole cleaning apparatuses in a drill string.

FIG. 10 illustrates an exemplary drilling environment in which hole cleaning apparatus 200 may be deployed. A drill string 300 is suspended in a wellbore 304 from a derrick 308 at a surface. Drill string 300 includes one or more drill pipes 312 connected to form a conduit and a drill bit 316 at the end of the conduit. At least one hole cleaning apparatus 200 is installed along drill string 300, for example, by making up connections between ends of the hole cleaning apparatus and other drill string components. In some cases, multiple hole cleaning apparatus 200 may be distributed along the length of drill string 300 to enhance hole cleaning at various points along the length of drill string 300. The installation of each hole cleaning apparatus 200 is such that the bore of the tool body of the hole cleaning apparatus is fluidly connected with the conduit formed by drill pipes 312. Besides drill pipe(s) 312, hole cleaning apparatus 200, and drill bit 316, drill string 300 may include several other tools known in the art of drilling.

Wellbore 304 is drilled by operating drill bit 316 to cut into surrounding subsurface formation 320. Typically, this involves rotating drill string 300 from the surface using a top drive 324 (or a rotary table in other examples). During drilling, a surface pump 328 is operated to pump drilling fluid (also known as mud) into drill string 300. The fluid pumped into drill string 300 will exit through nozzles in drill bit 316 into the bottom of wellbore 304 and then move up an annulus 332 between wellbore 304 and drill string 300 towards the surface, carrying along cuttings of the subsurface formation. At the surface, the fluid is diverted into a mud treatment system, cleaned up, and pumped back into the drill string.

Figure 11:
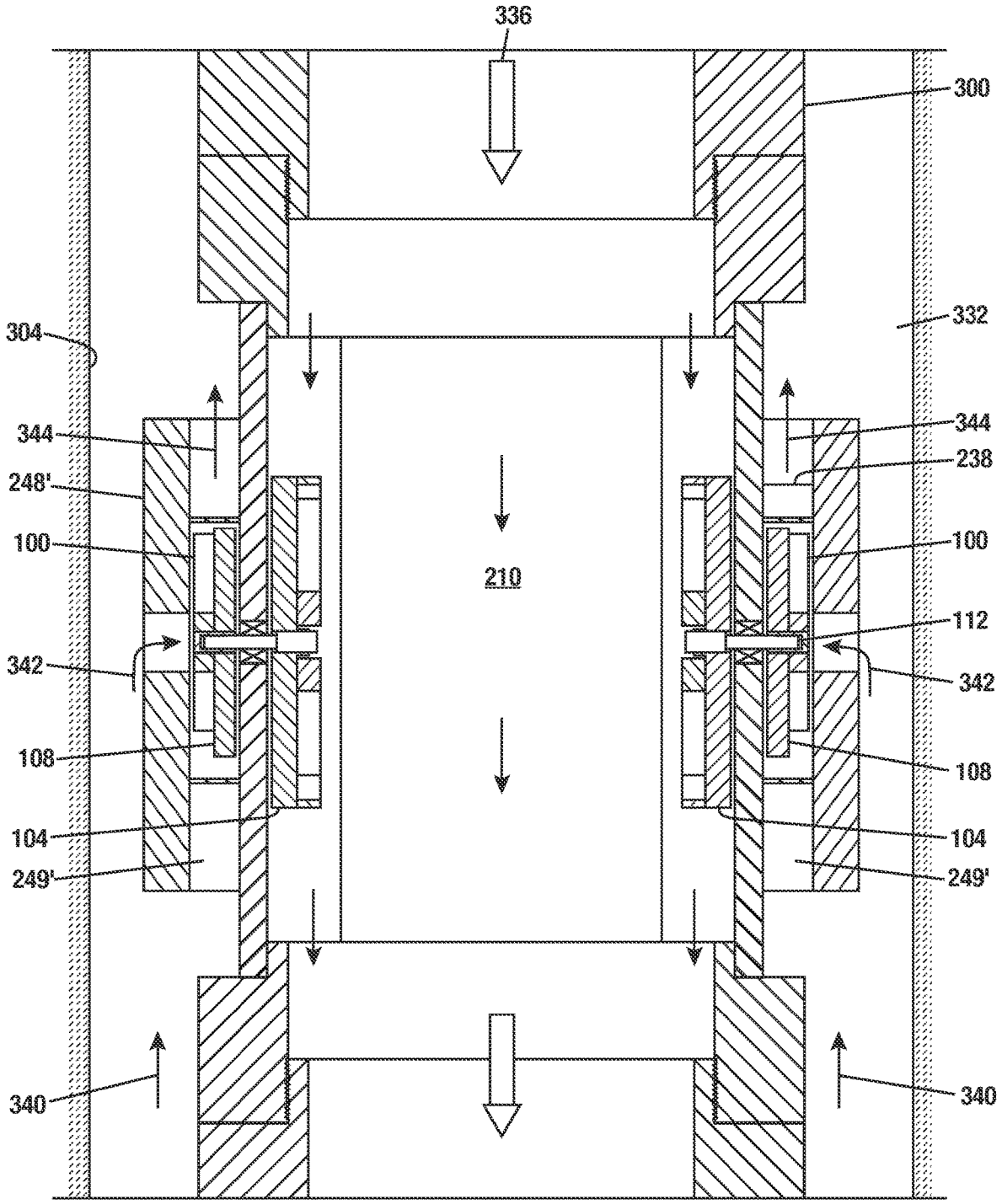
FIG. 11 is a schematic diagram showing flow patterns in a portion of a wellbore containing a hole cleaning apparatus with impeller casings.

FIG. 11 illustrates the flow pattern in wellbore 304 at the location of each hole cleaning apparatus for the implementation of hole cleaning apparatus 200 with impeller casings. The fluid pumped down drill string 300 is indicated by arrow 336. As fluid is pumped down the drill string, the fluid passes through bore 210 of hole cleaning apparatus 200. Turbine wheels 104 are exposed to the full flow pumped down drill string and passing through bore 210. The fluid passing through bore 210 will exert force on turbine wheels 104, causing turbine wheels 104 to rotate and drive impellers 108 through link rods 112. As fluid moves up annulus 332, as indicated by arrows 340, at least a portion of the fluid will enter the eyes of impellers 108, as indicated by arrows 342, and pass into the spaces between the impeller blades 128 to the circumference of the impellers. The rotating impellers 108 will accelerate the fluid radially towards the impeller casings 232, which will guide the fluid to outlet ports 238 and in a direction uphole, as shown by arrows 344.

Figure 12:
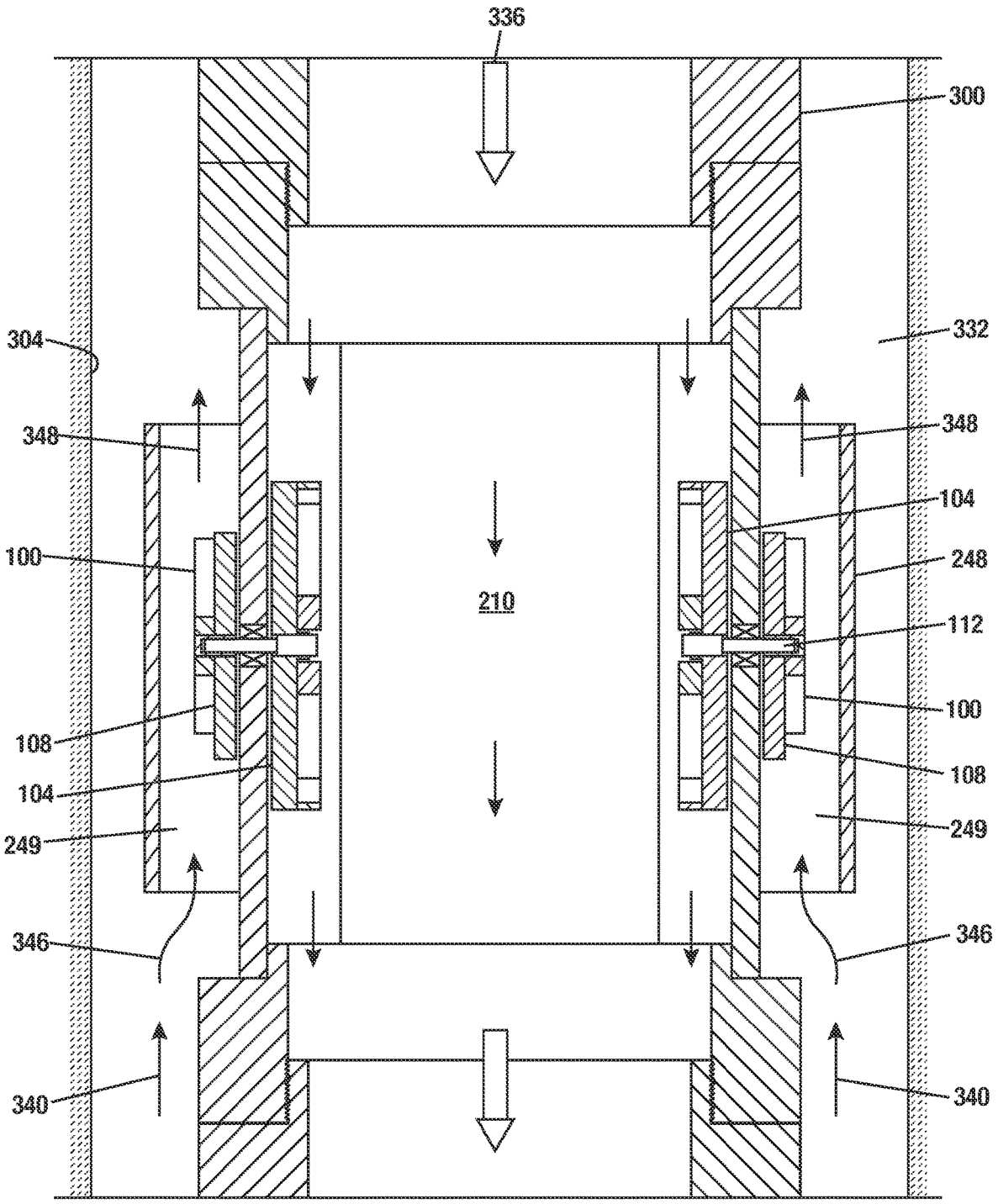
FIG. 12 is a schematic diagram showing flow patterns in a portion of a wellbore containing a hole cleaning apparatus without impeller casings.

Movement of fluid in annulus 332 is slightly different for the hole cleaning apparatus with impeller casings. As shown in FIG. 12, for the hole cleaning apparatus without impeller casings, fluid moving uphole in annulus 332 enters into channels 249 containing impellers 108 from the bottom of external shield 248, as shown by arrows 346. Impellers 108 will increase the velocity of the fluid passing through channels 249, and the fluid with the increased velocity head will exit channels 249 as shown by arrows 348.

In both flow patterns shown in FIGS. 11 and 12, the rotation of impellers 108 increases the pressure gradient in annulus 332. This increased pressure gradient enhances mixing of the fluid and formation cuttings in the annulus and forces the cuttings to move up the annulus and exit the wellbore.

The detailed description along with the summary and abstract are not intended to be exhaustive or to limit the embodiments to the precise forms described. Although specific embodiments, implementations, and examples are described herein for illustrative purposes, various equivalent modifications can be made without departing from the spirit and scope of the disclosure, as will be recognized by those skilled in the relevant art.

The invention claimed is:

1. An apparatus comprising:

a tool body having a wall and a lengthwise axis, the wall defining a bore that is aligned with the lengthwise axis;

one or more rotating assemblies coupled to the tool body, each of the rotating assemblies comprising:

a turbine wheel disposed adjacent to an inner surface of the wall and exposed to the bore, the turbine wheel having an axis of rotation transverse to the lengthwise axis;

an impeller disposed adjacent to an outer surface of the wall in a position corresponding to the turbine wheel, the impeller having an axis of rotation transverse to the lengthwise axis; and a link rod operatively coupling the turbine wheel to the impeller, the link rod to transfer mechanical energy generated by the turbine wheel to the impeller.

2. The apparatus of claim 1, wherein the link rod passes through a portion of the wall of the tool body between the turbine wheel and the impeller and is rotatably supported by a bearing mounted in the portion of the wall of the tool body.

3. The apparatus of claim 1, wherein the turbine wheel has a higher hydrodynamic drag in comparison to the impeller when the turbine wheel and the impeller are immersed in a fluid.

4. The apparatus of claim 1, wherein the impeller is an open impeller or a semi-open impeller.

5. The apparatus of claim 4, wherein the impeller is a radial impeller.

6. The apparatus of claim 1, further comprising an impeller casing mounted around the impeller to provide a chamber around the impeller that guides flow from the impeller, the impeller casing having an opening forming an outlet port that is fluidly connected to the chamber.

7. The apparatus of claim 6, wherein the chamber is a volute chamber.

8. The apparatus of claim 6, further comprising an external shield disposed around the tool body with a space between the external shield and the tool body to accommodate the impeller casing and the impeller, wherein the external shield includes an opening forming an inlet port that is fluidly connected to the chamber.

9. The apparatus of claim 1, wherein a plurality of the rotating assemblies are coupled to the tool body, and wherein the plurality of the rotating assemblies are uniformly distributed along a circumference of the tool body.

10. A drill string comprising:

a drill bit;

one or more drill pipes forming a conduit that is fluidly connected to the drill bit; and one or more hole cleaning apparatuses disposed along the conduit, each of the hole cleaning apparatuses comprising:

a tool body having a wall and a lengthwise axis, the wall defining a bore that is aligned with the lengthwise axis and fluidly connected to the conduit;

one or more rotating assemblies coupled to the tool body, each of the rotating assemblies comprising:

a turbine wheel disposed adjacent to an inner surface of the wall and exposed to the bore, the turbine wheel having an axis of rotation transverse to the lengthwise axis;

an impeller disposed adjacent to an outer surface of the wall in a position corresponding to the turbine wheel, the impeller having an axis of rotation transverse to the lengthwise axis; and a link rod operatively coupling the turbine wheel to the impeller, the link rod to transfer mechanical energy generated by the turbine wheel to the impeller.

11. The drill string of claim 10, wherein the turbine wheel of each of the one or more rotating assemblies has a higher hydrodynamic drag in comparison to the corresponding impeller when the turbine wheel and the corresponding impeller are immersed in a fluid.

12. The drill string of claim 11, wherein the impeller is an open impeller or a semi-open impeller.

13. The drill string of claim 11, wherein the impeller is a radial impeller.

14. The drill string of claim 10, further comprising an impeller casing mounted around each impeller to provide a chamber around the impeller that guides flow from the impeller, each impeller casing having an opening forming an outlet port that is fluidly connected to the chamber.

15. The drill string of claim 14, wherein the chamber is a volute chamber.

16. The drill string of claim 14, further comprising an external shield disposed around the tool body with a space between the external shield and tool body to accommodate each impeller casing and corresponding impeller, wherein the external shield includes an opening forming an inlet port that is fluidly connected to the chamber.

17. The drill string of claim 16, wherein each impeller casing is connected to the external shield.

18. The drill string of claim 10, wherein a plurality of the rotating assemblies are coupled to the tool body of each hole cleaning apparatus, and wherein the plurality of the rotating assemblies are uniformly distributed along a circumference of the tool body.

19. A method comprising:

disposing a drill string including at least one hole cleaning apparatus in a wellbore;

pumping a fluid into the drill string while operating the drill string to cut into a subsurface formation around the wellbore;

returning the fluid pumped into the drill string and cuttings from the subsurface formation to a surface through an annulus between the drill string and the wellbore;

during pumping of the fluid into the drill string, rotating at least one turbine wheel disposed inside a tool body of the hole cleaning apparatus by the fluid passing through the drill string;

rotating at least one impeller disposed outside the tool body of the hole cleaning apparatus in response to rotation of the at least one turbine wheel; and increasing a pressure of the fluid in the annulus at a location of the at least one impeller by the rotation of the at least one impeller;

wherein rotating the at least one impeller comprises rotating the at least one impeller about an axis of rotation that is transverse to a lengthwise axis of the tool body of the hole cleaning apparatus.

20. A method comprising:

disposing a drill string including at least one hole cleaning apparatus in a wellbore;

pumping a fluid into the drill string while operating the drill string to cut into a subsurface formation around the wellbore;

returning the fluid pumped into the drill string and cuttings from the subsurface formation to a surface through an annulus between the drill string and the wellbore;

during pumping of the fluid into the drill string, rotating at least one turbine wheel disposed inside a tool body of the hole cleaning apparatus by the fluid passing through the drill string;

rotating at least one impeller disposed outside the tool body of the hole cleaning apparatus in response to rotation of the at least one turbine wheel; and increasing a pressure of the fluid in the annulus at a location of the at least one impeller by the rotation of the at least one impeller;

wherein rotating the at least turbine wheel comprises rotating the at least one turbine wheel about an axis of rotation that is transverse to a lengthwise axis of the tool body of the hole cleaning apparatus, and wherein rotating the at least one impeller comprises rotating the at least one impeller about an axis of rotation that is transverse to the lengthwise axis of the tool body of the hole cleaning apparatus.

* * * * *